US010882165B2

(12) United States Patent
Van Essen et al.

(10) Patent No.: US 10,882,165 B2
(45) Date of Patent: Jan. 5, 2021

(54) DRIVE GUIDE

(71) Applicant: MILWAUKEE ELECTRIC TOOL CORPORATION, Brookfield, WI (US)

(72) Inventors: James J. Van Essen, Hales Corners, WI (US); Jacob A. Krabbe, Milwaukee, WI (US); Michael J. Zimmermann, New Berlin, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 195 days.

(21) Appl. No.: 16/043,460

(22) Filed: Jul. 24, 2018

(65) Prior Publication Data

US 2019/0030695 A1 Jan. 31, 2019

Related U.S. Application Data

(60) Provisional application No. 62/536,533, filed on Jul. 25, 2017.

(51) Int. Cl.

| | |
|---|---|
| ***B25B 23/00*** | (2006.01) |
| ***B25B 23/12*** | (2006.01) |
| ***B25B 21/00*** | (2006.01) |
| ***B25H 1/00*** | (2006.01) |

(Continued)

(52) U.S. Cl.

CPC ..... *B25B 23/0064* (2013.01); *B25B 21/00* (2013.01); *B25B 23/0007* (2013.01); *B25B 23/12* (2013.01); *B25F 5/003* (2013.01); *B25H 1/0078* (2013.01); *B25B 23/08* (2013.01)

(58) Field of Classification Search

CPC . B25B 23/0064; B25B 23/0007; B25B 23/08; B25B 23/12; B25B 21/00; B25B 21/002; B25B 21/007; B25F 5/003; G01B 3/28

See application file for complete search history.

(56) References Cited

U.S. PATENT DOCUMENTS

| | | | |
|---|---|---|---|
| 1,333,437 | A | 3/1920 | Monroe |
| 1,539,782 | A | 5/1925 | Stansell |
| 1,593,233 | A | 7/1926 | Wilson |

(Continued)

FOREIGN PATENT DOCUMENTS

| | | | |
|---|---|---|---|
| DE | 102005017872 | A1 | 10/2006 |
| EP | 1245347 | B1 | 3/2002 |

(Continued)

OTHER PUBLICATIONS

"2011 Wera Catalog" Wera Tools Inc., Burlington Ontario Canada.
European Patent Office Search Report for Application No. 18184737.7, dated Jun. 19, 2019, 9 pages.

*Primary Examiner* — David B. Thomas
(74) *Attorney, Agent, or Firm* — Michael Best & Friedrich LLP

(57) ABSTRACT

A drive guide connectable to a power tool includes a shank, a barrel, and a sleeve. The shank includes a tool coupling portion and a barrel coupling portion. The barrel is coupled to the barrel coupling portion of the shank. The barrel includes a bit coupling portion configured to couple to a tool bit. The barrel also includes a depth indicium disposed on a surface of the barrel. The sleeve is disposed concentrically about and slidable along the barrel. An edge of the sleeve provides a visual indicator to determine depth based on the depth indicium.

21 Claims, 7 Drawing Sheets

(51) Int. Cl.
*B25F 5/00* (2006.01)
*B25B 23/08* (2006.01)

(56) References Cited

U.S. PATENT DOCUMENTS 1,644,074 A 10/1927 Morgan
1,708,766 A 4/1929 Lochner
1,712,196 A 5/1929 Burger et al.
1,769,067 A 7/1930 Meunier
1,810,704 A 6/1931 Gentry
1,889,330 A 11/1932 Humes et al.
1,925,385 A 9/1933 Humes et al.
2,382,639 A 8/1945 Kennard
2,620,000 A 12/1952 Noffsinger
2,633,168 A 3/1953 Mahaffey
2,643,379 A 6/1953 Matovich
2,694,329 A 11/1954 Thompson et al.
2,698,637 A 1/1955 Donovan
2,706,506 A 4/1955 Wagner
2,780,257 A 2/1957 Duggan
3,182,697 A 5/1965 Bonewits
3,244,208 A 4/1966 McKenzie
3,320,832 A 5/1967 Jensen
3,532,142 A 10/1970 Ziegler
3,633,640 A 1/1972 Moore
3,739,825 A 6/1973 Knox
3,973,605 A 8/1976 Decaro
4,018,254 A 4/1977 DeCaro
4,140,161 A 2/1979 Russo et al.
4,146,071 A * 3/1979 Mueller ..... B25B 21/00 227/136
4,237,946 A 12/1980 Leitner
4,424,729 A 1/1984 Jacobson
4,455,898 A 6/1984 Marbourg, Jr.
4,510,826 A 4/1985 Marks
4,581,962 A 4/1986 Marbourg
4,611,515 A 9/1986 Marbourg, Jr.
4,736,658 A 4/1988 Jore
4,766,783 A * 8/1988 Stanich ..... B25B 13/481 81/177.2
5,012,708 A 5/1991 Martindell
5,025,688 A 6/1991 Davis
5,029,498 A 7/1991 Kinsey
5,056,386 A 10/1991 Chaconas
5,182,973 A 2/1993 Martindell
5,309,799 A * 5/1994 Jore ..... B25B 15/00 81/451
5,458,030 A 10/1995 Betts
D377,745 S 2/1997 Laun
D379,578 S 6/1997 Daniels
5,690,006 A 11/1997 Pulliam
5,775,186 A 7/1998 Rahm
5,791,207 A 8/1998 Ahdoot
5,791,212 A 8/1998 Han
5,806,381 A 9/1998 Lin
5,873,175 A 2/1999 Johnston
5,927,161 A 7/1999 Clifford et al.
6,082,233 A 7/2000 Han
6,128,982 A 10/2000 Gwin, Sr.
6,148,699 A 11/2000 Han
6,244,141 B1 6/2001 Han
6,363,819 B1 4/2002 Li
6,511,268 B1 1/2003 Vasudeva et al.
6,668,941 B2 12/2003 Phillips et al.
D498,403 S 11/2004 Singh
6,830,552 B1 12/2004 Gonzalez
6,860,178 B2 3/2005 Wang
D516,894 S 3/2006 Singh
D525,101 S 7/2006 Singh
7,069,826 B2 7/2006 Tilton
7,210,382 B2 * 5/2007 McCracken ..... B25B 23/0064 81/125
7,210,881 B2 5/2007 Greenberg
7,481,136 B2 1/2009 Chaing
7,513,722 B2 4/2009 Gereenberg et al.
D601,866 S 10/2009 Carroll
D604,128 S 11/2009 Carroll
7,779,734 B2 8/2010 Nichols, Jr.
8,061,000 B2 11/2011 Santamarina et al.
8,302,513 B2 * 11/2012 Evatt ..... B25B 23/0064 81/451
D673,193 S 12/2012 Dickrede
D678,369 S 3/2013 Santamarina
D687,872 S 8/2013 Santamarina
8,534,165 B2 9/2013 Wente et al.
8,602,285 B2 12/2013 Santamarina et al.
8,662,801 B2 3/2014 Santamarina et al.
8,721,234 B2 5/2014 Santamarina et al.
8,740,513 B2 6/2014 Santamarina et al.
8,881,625 B2 11/2014 Jenkins
9,021,925 B2 * 5/2015 Weber ..... B25B 15/001 81/184
9,050,665 B2 6/2015 Greenberg
9,211,637 B1 12/2015 Hewitt et al.
9,415,491 B1 8/2016 Hewitt et al.
D808,748 S 1/2018 Griffore et al.
2005/0166725 A1 8/2005 Chen
2006/0254394 A1 11/2006 Cantlon et al.
2007/0034060 A1 2/2007 McCracken
2007/0044329 A1 3/2007 Mitchell et al.
2009/0038447 A1 1/2009 McCracken et al.
2009/0139379 A1 6/2009 Chiang et al.
2011/0000344 A1 1/2011 Summers
2013/0312577 A1 11/2013 Burrows et al.
2014/0074226 A1 * 3/2014 Bielefeld ..... B25B 15/02 623/2.11
2015/0319908 A1 11/2015 Kuss et al.
2016/0023333 A1 1/2016 Chen
2016/0107299 A1 4/2016 Hsu
2017/0028538 A1 2/2017 Lourenco

FOREIGN PATENT DOCUMENTS

EP 3195981 A1 7/2017
WO 9313914 A1 7/1993

* cited by examiner

DRIVE GUIDE

CROSS-REFERENCE TO RELATED APPLICATIONS

This application claims the benefit of U.S. Provisional Patent Application No. 62/536,533, filed Jul. 25, 2017, the entire contents of which are hereby incorporated by reference.

FIELD OF THE INVENTION

The present disclosure relates to the field of drivers and particularly a drive guide connectable to power tools.

SUMMARY

The present invention provides, in one aspect, a drive guide connectable to a power tool. The drive guide includes a shank having a tool coupling portion and a barrel coupling portion. The drive guide also includes a barrel coupled to the barrel coupling portion of the shank. The barrel includes a bit coupling portion configured to couple to a tool bit. The barrel also includes a depth indicium disposed on a surface of the barrel. The drive guide further includes a sleeve disposed concentrically about and slidable along the barrel. An edge of the sleeve provides a visual indicator to determine depth based on the depth indicium.

The present invention provides, in another aspect, a drive guide connectable to a power tool. The drive guide includes a shank having a tool coupling portion and a barrel coupling portion. The drive guide also includes a barrel coupled to the barrel coupling portion of the shank. The barrel includes a bit coupling portion. The barrel also includes a set of axially aligned and axially spaced depth indicia. The drive guide further includes a sleeve disposed concentrically about and slidable along the barrel. The sleeve includes an indicator disposed adjacent an end of the sleeve that receives the barrel. The indicator of the sleeve provides a visual indication of depth based on the set of axially aligned and axially spaced depth indicia.

The present invention provides, in a further aspect, a method for operating a drive guide coupled to a power tool. The drive guide includes a shank having a tool coupling portion and a bit coupling portion, a barrel coupled to the bit coupling portion and having a bit receiving portion and a depth indicium, and a sleeve disposed concentrically about and slidable along the barrel. The method includes coupling the shank to the power tool, inserting a fastener into the barrel through a first axial end of the sleeve, and driving the fastener, by the power tool and the drive guide, into a workpiece. The method also includes moving the sleeve, by contacting the workpiece, axially along the barrel as the fastener is driven into the workpiece, and stopping driving the fastener when an edge of a second axial end of the sleeve opposite the first axial end is axially aligned with the depth indicium.

Other features and aspects of the invention will become apparent by consideration of the following detailed description and accompanying drawings.

DETAILED DESCRIPTION

Figure 1:
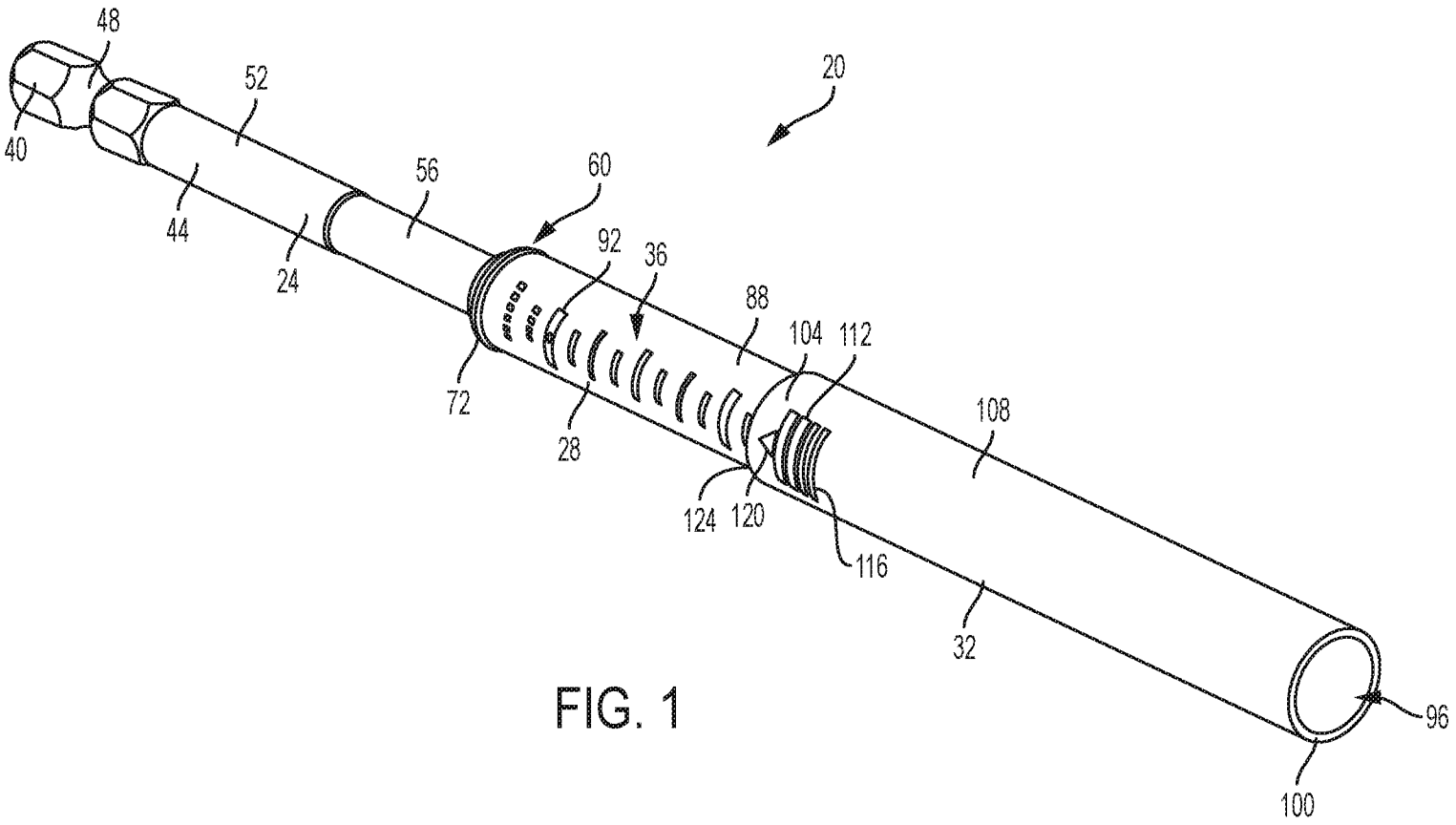
FIG. 1 is perspective view of a drive guide.
Figure 2:
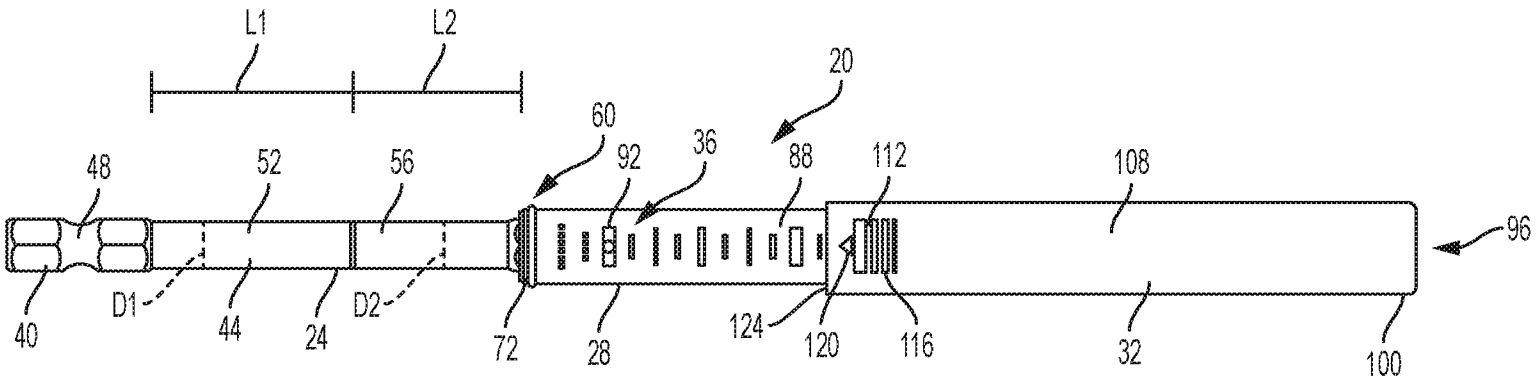
FIG. 2 is a first side view of the drive guide.
Figure 3:
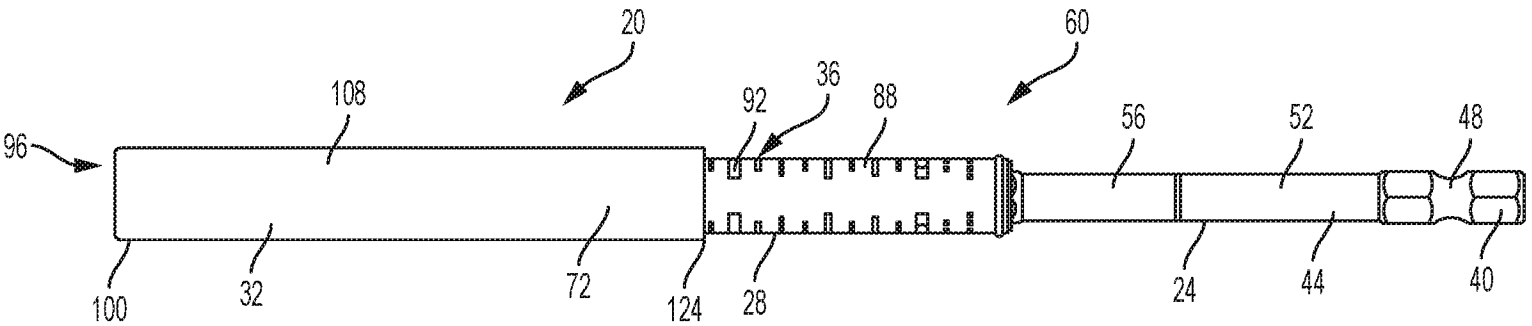
FIG. 3 is a second side view of the drive guide.
Figure 4:
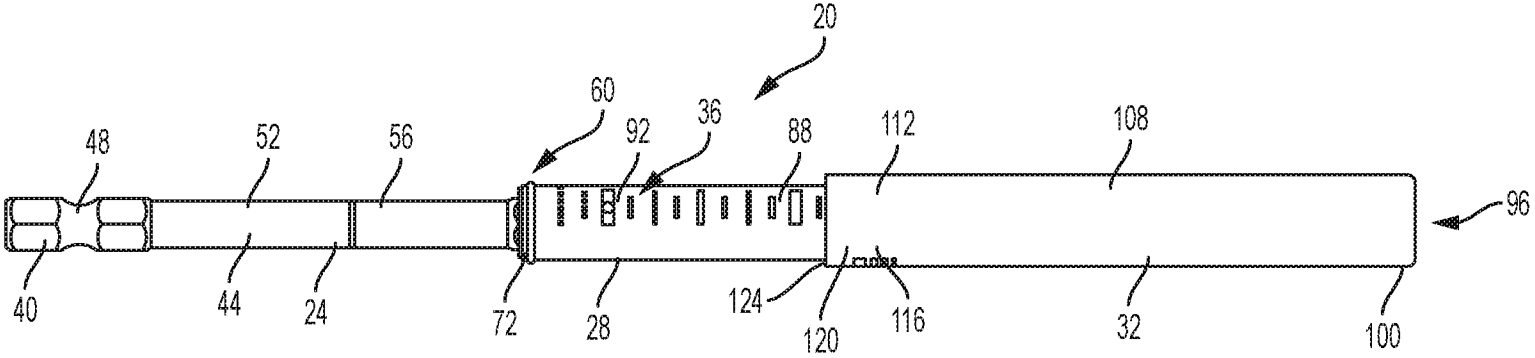
FIG. 4 is a third side view of the drive guide.
Figure 5:
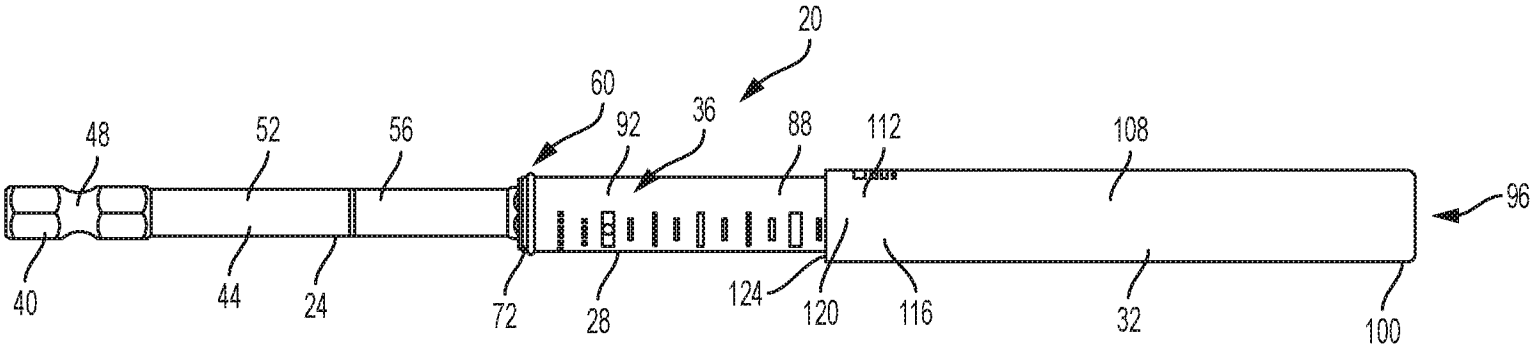
FIG. 5 is a fourth side view of the drive guide.
Figure 6:
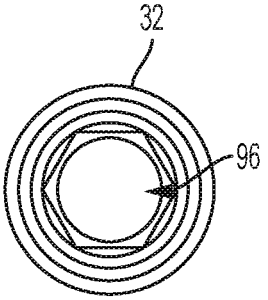
FIG. 6 is a front view of the drive guide.
Figure 7:
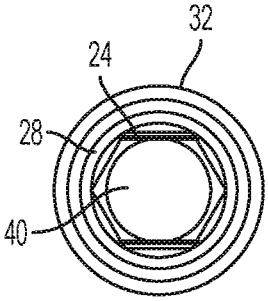
FIG. 7 is a rear view of the drive guide.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. As used herein, the term "approximately" refers to values that are within a rounding value or manufacturing tolerances of the recited values.

FIGS. 1-9 illustrate a drive guide 20 configured to be operatively coupled to a tool (e.g., a drill) to drive a fastener (e.g., a screw, etc.). The drive guide 20 includes a shank 24, a barrel 28, and a sleeve 32. As will be described in greater detail below, the illustrated drive guide 20 also includes depth indicia 36 on the barrel 28 to help a user drive the fastener to a desired depth within a workpiece. In the illustrated embodiment, the drive guide 20 includes a plurality of sets of depth indicia 26. In other embodiments, the drive guide 20 may include fewer or more sets of depth indicia 26 than those described below, or the drive guide 20 may include a single depth indicium.

Figure 8:
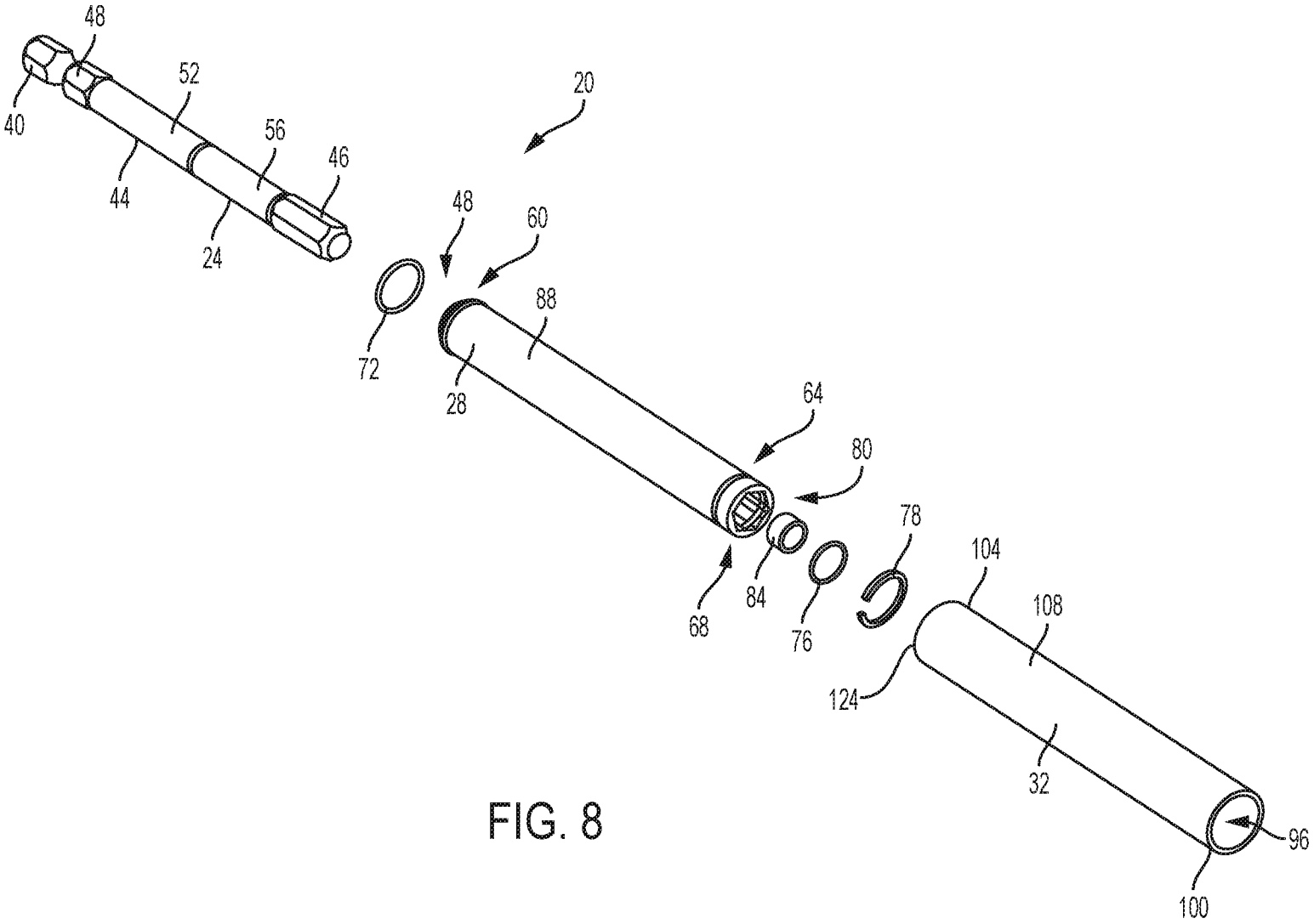
FIG. 8 is an exploded view of the drive guide.

With specific reference to FIGS. 1-8, the shank 24 includes a tool coupling portion 40, a cylindrical extension portion 44, and a barrel coupling portion 46 (FIG. 8). The tool coupling portion 40 has a hexagonal cross section and includes a circumferential coupling groove 48 so the shank 24 may be coupled to, for example, a power tool or hand tool chuck. The cylindrical extension portion 44 extends away from the tool coupling portion 40 and includes a first section 52 having a first diameter D1 and a first axial length L1, and a second section 56 having a second diameter D2 and a second axial length L2. In the illustrated embodiment, the first diameter D1 is larger than the second diameter D2 (i.e., the second diameter D2 is a reduced diameter portion). Furthermore, the first axial length L1 is larger than the second axial length L2. However, in other embodiments, the first diameter D1 may be smaller than the second diameter D2 and/or the first axial length L1 may be smaller than the second axial length L2. In other embodiments, the first section 52 or the second section 56 may be omitted (i.e., such that the cylindrical extension portion 44 has a uniform diameter). In other embodiments, the cylindrical extension portion 44 may be a hexagonal extension portion (i.e., may have a hexagonal cross section). In this embodiment, the hexagonal extension portion may be sized differently than the hexagonal cross section of the tool coupling portion 40 or may be the same size such that the hexagonal extension portion is generally coextensive with the tool coupling portion 40. The barrel coupling portion 46 extends away from the second section 56 of the extension portion 44. In the illustrated embodiment, the barrel coupling portion 46 has a hexagonal cross section and is received by the barrel 28.

With continued reference to FIGS. 1-8, the barrel 28 is fixedly or removably coupled to the barrel coupling portion 46 of the shank 24. The illustrated barrel 28 includes a bore 48 at a first end 60 and a bit coupling portion 68 at a second end 64 that is opposite the first end 60. The bore 48 receives the barrel coupling portion 46 of the shank 24. A first retention ring 72 is coupled proximate the first end 60 of the barrel 28, and a second retention ring 78 is coupled proximate the second end 64 of the barrel 28. The first retention ring 72 and the second retention ring 78 retain the sleeve 32 on the barrel 28. The bit coupling portion 68 includes a hexagonal bore 80 configured to receive and retain a tool bit (e.g., a Phillips or flathead screw driver bit, a Torx bit, a hex bit, etc.). In the illustrated example, the bit coupling portion 68 includes a magnet 84 and a bit retention ring 76 disposed within the hexagonal bore 80 to retain a magnetic tool bit within the bit coupling portion 68. However, other bit retention mechanisms (e.g., detents, etc.) may be used in place of or in addition to the magnet 84.

With specific reference to FIGS. 2-5, the barrel 28 includes a cylindrical sidewall 88 extending between the first end 60 and the second end 64. The cylindrical sidewall 88 includes the depth indicia 36. In some embodiments, the depth indicia 36 are laser etched onto the sidewall 88 so the indicia 36 do not wear off easily. In addition, the laser etched depth indicia 26 do not extend beyond the sidewall 88 of the barrel 28 and interfere with movement of the sleeve 32. As seen in FIGS. 2-5, the illustrated barrel 28 includes three sets of depth indicia 36 (the depth indicia 36 are omitted from FIG. 8 for ease of illustration). Each depth indicia 36 includes multiple depth indicium. Each set of depth indicia 36 includes a plurality of discrete, axially aligned and axially spaced markers 92 that visually indicate depth to a user. The size and shape of the markers 92 are varied to, for example, indicate various measurement intervals. In addition, at least one marker 92 may include an annotation (e.g., a number, text, etc.). The markers 92 of each set of depth indicia 36 are aligned with, but circumferentially spaced from, corresponding markers 92 in other sets of depth indicia 36. For example, a center point of each marker 92 in each set of depth indicia 36 may be spaced from center points of adjacent markers 92 in other sets of depth indicia 36 by approximately 120 degrees. In other embodiments, the barrel 28 may include two sets of depth indicia 36 spaced 180 degrees, four sets of depth indicia 36 spaced 90 degrees, and the like. The length and thickness of each marker 92 may be varied. In addition, the color of each marker 92 may be varied. Each set of depth indicia 36 may be spaced (circumferentially or axially) evenly or unevenly.

With renewed reference to FIGS. 1-8, the sleeve 32 is movably coupled concentrically about the barrel 28. In the illustrated embodiment, the sleeve 32 is slidable axially along the barrel 28 between the first retention ring 72 and the second retention ring 78. The second retention ring 78 also provides a damping of the movement of the sleeve 32 relative to the barrel 28. The illustrated sleeve 32 is cylindrical and includes an axial bore 96 extending from a first axial end 100 through a second axial end 104, such that the barrel 28 may be received within the bore 96 via the second axial end 104. In addition, a fastener, coupled to a bit disposed within the bit coupling portion 68, may similarly be supported within the bore 96 via insertion into the first axial end 100.

As seen in FIG. 1, a sidewall 108 of the sleeve 32 includes an indicator 112 adjacent the second axial end 104. Similar to the indicia 36, in some embodiments, the indicator 112 may be laser etched on the sleeve 32. The illustrated indicator 112 includes a set of axially spaced lines 116 increasing in thickness towards the second axial end 104, with an arrow 120 disposed between one line 116 and the second axial end 104. The arrow 120 and axially spaced lines 116 of the indicator 112 create a distinct design from the depth indicium 36 on the barrel 28. The indicator 112 helps identify an edge 124 of the second axial end 104 of the sleeve 32 when the drive guide 20 is rotating at relatively high speeds. In other embodiments, the indicator 112 may be varied (e.g., circumferential line(s), arrows, etc.) or omitted. The edge 124 is used as a reference point by the user in relation to the depth indicia 36 on the barrel 28, as will be explained below.

Figure 9A:
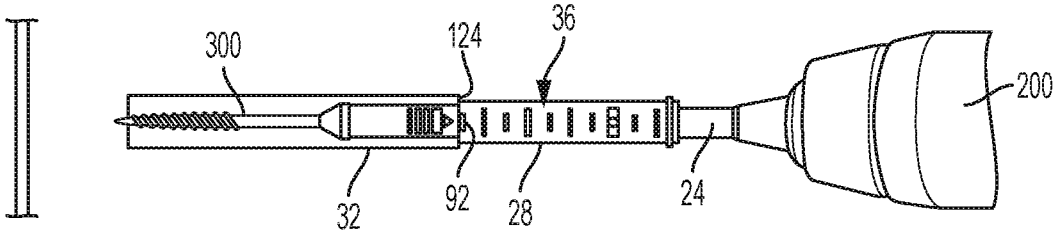
FIGS. 9A-D illustrate the drive guide of FIG. 1 being operated by a power tool.

With reference to FIGS. 9A-D, the operation of the drive guide 20 will be described. As seen in FIG. 9A, the drive guide 20 is coupled to a power tool 200 (e.g., a drill) by coupling the shank 24 to a chuck of the power tool 200. In addition, a fastener 300 (e.g., a screw) is coupled to a bit (not shown) that is retained within the bit coupling portion 68 of the barrel 28 via insertion into the bore 96 through the first axial end 100 of the sleeve 32.

Figure 9B:
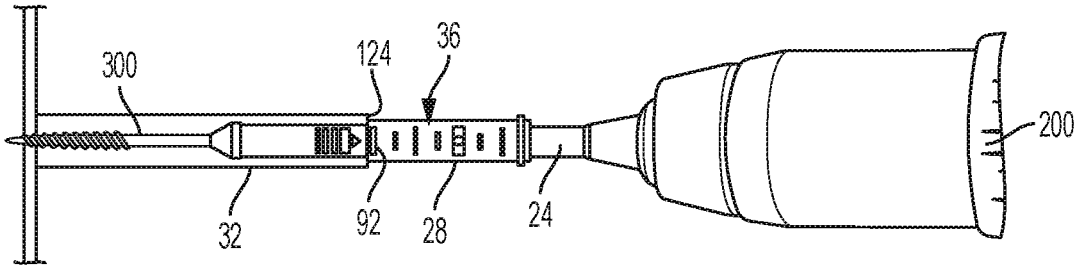

As seen in FIG. 9B, the drive guide 20 and the fastener 300 are moved towards the workpiece and the power tool 200 is operated to drive rotation of the drive guide 20. The rotation of the drive guide 20 causes the depth indicia 36 to visually 'blend' such that the distinct, circumferentially spaced markers 92 of each set of depth indicia 36 appear to be a single, solid line extending about the entire circumference of the barrel 28. In addition, the edge 124 of the sleeve 32 indicates a starting location on the sleeve 32 via alignment of the edge 124 and a first depth marking 92 of the each set of depth indicia 36.

Figure 9C:
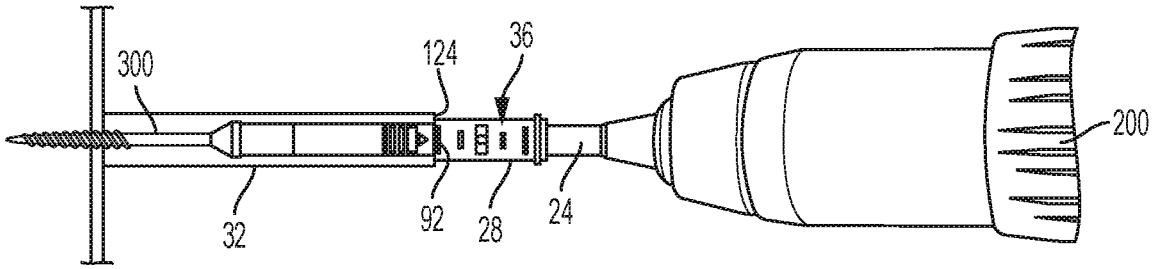

As seen in FIG. 9C, the fastener 300 is driven into the workpiece and the power tool 200 is advanced toward the workpiece. At the same time, the first axial end 100 of the sleeve 32 engages the workpiece, pushing the sleeve 32 to slide axially along the barrel 28 toward the first end 60 of the barrel 28. Again, the edge 124 of the sleeve 32 will align with different markers 92 of the sets depth indicia 36 such that a user can ascertain the depth of the fastener 300 as the fastener 300 is driven into the workpiece.

Figure 9D:
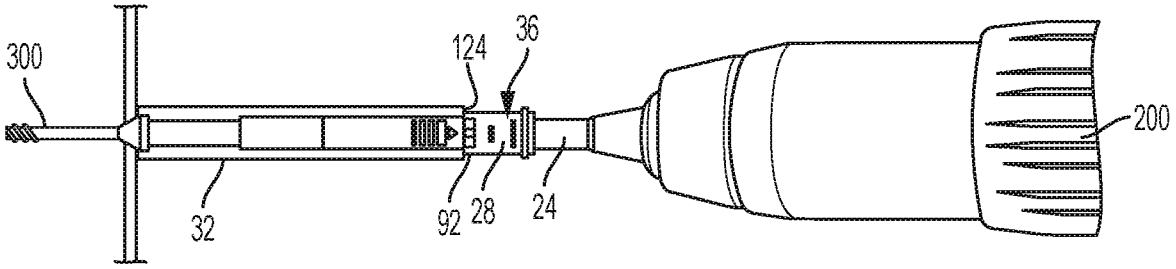

As seen in FIG. 9D, the user can utilize the alignment of the edge 124 and another marking 92 of each set of the depth indicia 36 to determine that the fastener 300 has reached a desired depth in the workpiece that may be predetermined by the user (e.g., the depth at which the fastener is flush with the workpiece). At this point, the power tool 200 and the drive guide 20 may be displaced away from the workpiece and the fastener 300, leaving the fastener 300 within the workpiece at the desired depth. The sleeve 32 can then be reset (e.g., by sliding the sleeve 32 away from the first end 60 of the barrel 28) for additional use.

With continued reference to FIG. 9D, when the fastener 300 has reached a desired depth in the workpiece that may be predetermined by the user, the sleeve 32 is not fully retracted toward the first retention ring 72 and the fastener 300 is not visible to the user. As such, the circumferentially spaced markers 92 of the depth indicia 36 allow the user to determine when the screw has reached the desired depth even though the fastener is not visible to the user.

Figure 10:
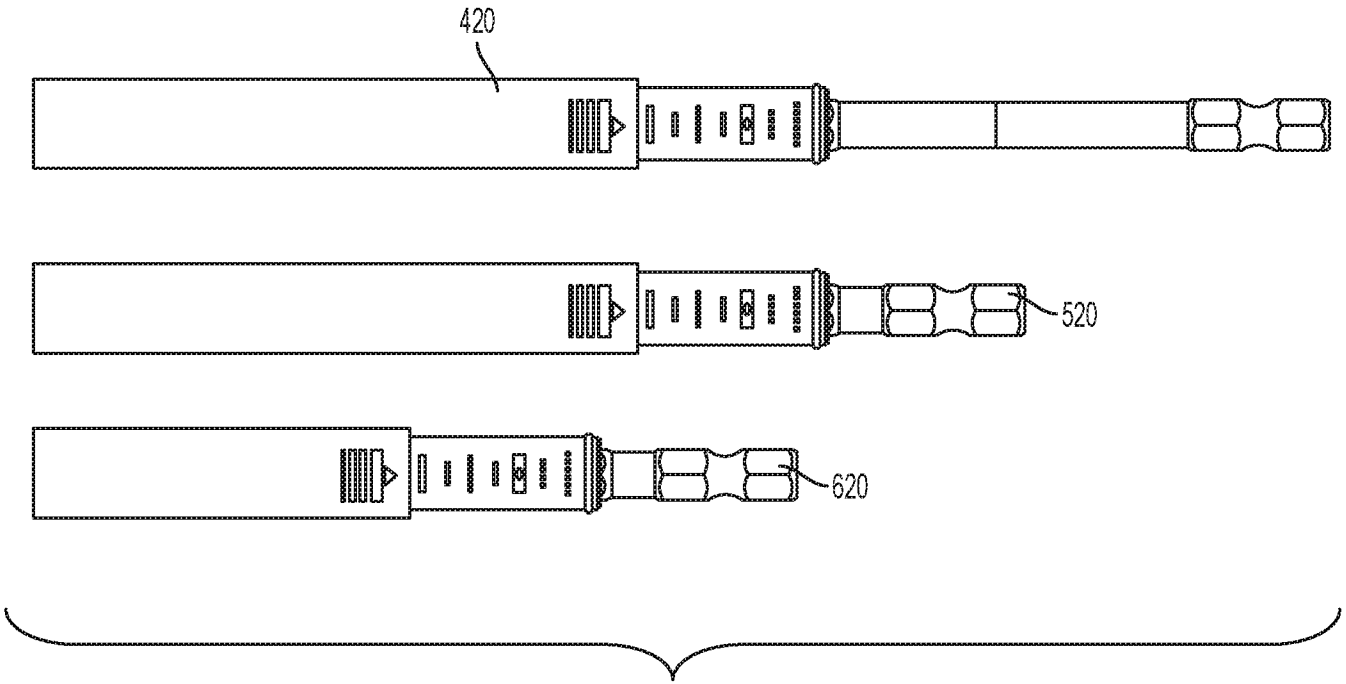
FIG. 10 is a side view of a set of different-sized drive guides.

FIG. 10 illustrates a set of drive guides 420, 520, 620 similar to the drive guide 20 described above. The set of drive guides 20, 420, 520, 620 may include varied sizes (e.g., varied axial lengths of the cylindrical portion of the shank 24, the barrel 28, and the sleeve 32, etc.), varied sizes of the bit coupling portion 68 (e.g., to receive tool bit shanks 24 having varied sizes, etc.), and varied sizes of the power tool coupling portion 40 (e.g., to be received by various tool chucks).

The drive guides described above have certain advantageous characteristics. For example, the circumferential spacing of the sets of depth indicia 36 allows a user to see a solid line on the barrel 28 while the drive guide 20 is rotated, yet does not require that the depth indicia 36 to be applied as solid lines extending about the entire circumference of the barrel 28. This feature makes manufacturing of the drive guide 20 easier and less expensive. In another example, the approximately 120 degree spacing of markings of each set of depth indicia 36, as described above, allows the drive guide 20 to be packaged for sale at any rotational orientation, while still allowing a potential customer to see the depth indicia 36. This allows the manufacturer to package the drive guide 20 without clocking the product to a specific orientation within the package. In yet another example, the laser etched depth indicia 36 is a wear-resistant way of marking the barrel 28, reducing the possibility of the drive guide 20 losing functionality due to wearing or removal of the depth indicia 36. In a final example, the use of the edge of the sleeve 32 as a visual indicator to determine the depth of the fastener 300 based on the sets depth indicia 36 allows a user to determine when a desired depth (e.g., a point at which the fastener 300 is flush) is reached even though the fastener is not visible to the user and the sleeve 32 is not fully retracted when the desired depth is reached.

The sets of depth indicia 36 also may provide standard reference points for standard fastener sizes. That is, each set of depth indicia 36 may correspond to a 'flush' position of a standard sized fastener. In sum, this design obviates (but does not preclude) other depth visualization devices/techniques such as slots in the sleeve 32, transparent portions of the sleeve 32, or an entirely transparent sleeve 32 that allow a user to view the fastener within the sleeve as it is being driven to the desired depth. As such, the sleeve 32 may be manufactured at a lower cost and have a high degree of structural integrity.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A drive guide connectable to a power tool, the drive guide comprising:

a shank including a tool coupling portion and a barrel coupling portion;

a barrel coupled to the barrel coupling portion of the shank, the barrel including a bit coupling portion configured to couple to a tool bit, the barrel also including a depth indicium disposed on a surface of the barrel; and a sleeve disposed concentrically about and slidable along the barrel;

wherein an edge of the sleeve provides a visual indicator to determine depth based on the depth indicium; and wherein the barrel includes three depth indicia that are circumferentially aligned and circumferentially spaced about the barrel.

2. The drive guide of claim 1, wherein the three depth indicia are evenly spaced relative to one another by approximately 120 degrees.

3. The drive guide of claim 1, wherein each depth indicia includes a plurality of axially aligned and axially spaced markers.

4. The drive guide of claim 1, wherein the depth indicium is laser etched into the barrel.

5. The drive guide of claim 1, wherein the shank further includes a cylindrical extension portion extending between the tool coupling portion and the barrel coupling portion.

6. The drive guide of claim 1, wherein the barrel includes a first retention ring coupled proximate a first end of the barrel and a second retention ring coupled proximate a second end of the barrel, and wherein the sleeve is axially retained between the first retention ring and the second retention ring.

7. The drive guide of claim 1, wherein the bit coupling portion includes a hexagonal bore configured to receive and retain the tool bit.

8. The drive guide of claim 1, wherein the sleeve includes an indicator disposed adjacent the edge of the sleeve.

9. The drive guide of claim 8, wherein the indicator on the sleeve has a distinct design from the depth indicium on the barrel.

10. The drive guide of claim 9, wherein the indicator includes a set of axially spaced lines increasing in thickness towards the edge of the sleeve and an arrow disposed between the set of axially spaced lines and the edge of the sleeve.

11. The drive guide of claim 8, wherein the depth indicium is laser etched in the barrel, and wherein the indicator is laser etched in the sleeve.

12. A drive guide connectable to a power tool, the drive guide comprising:

a shank including a tool coupling portion and a barrel coupling portion;

a barrel coupled to the barrel coupling portion of the shank, the barrel including a bit coupling portion, the barrel also including a set of axially aligned and axially spaced depth indicia; and a sleeve disposed concentrically about and slidable along the barrel, the sleeve including an indicator disposed adjacent an end of the sleeve that receives the barrel;

wherein the indicator of the sleeve provides a visual indication of depth based on the set of axially aligned and axially spaced depth indicia.

13. The drive guide of claim 12, wherein the barrel includes three sets of depth indicia that are circumferentially aligned and circumferentially spaced about the barrel.

14. The drive guide of claim 12, wherein the set of depth indicia is laser etched in the barrel, and wherein the indicator is laser etched in the sleeve.

15. A method for operating a drive guide coupled to a power tool, the drive guide including a shank having a tool coupling portion and a bit coupling portion, a barrel coupled to the bit coupling portion and having a bit receiving portion and a depth indicium, and a sleeve disposed concentrically about and slidable along the barrel, the method comprising:

coupling the shank to the power tool;

inserting a fastener into the barrel through a first axial end of the sleeve;

driving the fastener, by the power tool and the drive guide, into a workpiece;

moving the sleeve, by contacting the workpiece, axially along the barrel as the fastener is driven into the workpiece; and stopping driving the fastener when an edge of a second axial end of the sleeve opposite the first axial end is axially aligned with the depth indicium wherein the depth indicium is laser etched in the barrel.

16. The method of claim 15, wherein the barrel includes a set of axially spaced and axially aligned depth indicia, wherein the depth indicium is one of the set of depth indicia, and further comprising moving the sleeve, prior to driving the fastener, axially along the barrel to a starting location where the edge of the second axial end of the sleeve is aligned with another depth indicium of the set of depth indicia.

17. The method of claim 15, wherein the barrel includes three depth indicia that are circumferentially aligned and circumferentially spaced about the barrel, and wherein driving the fastener includes rotating the drive guide at a speed to blend the three depth indicia together.

18. A drive guide connectable to a power tool, the drive guide comprising:

a shank including a tool coupling portion and a barrel coupling portion;

a barrel coupled to the barrel coupling portion of the shank, the barrel including a bit coupling portion configured to couple to a tool bit, the barrel also including a depth indicium disposed on a surface of the barrel; and a sleeve disposed concentrically about and slidable along the barrel;

wherein an edge of the sleeve provides a visual indicator to determine depth based on the depth indicium; and wherein the depth indicium is one of a set of depth indicia, and wherein the set of depth indicia includes a plurality of axially aligned and axially spaced markers.

19. A drive guide connectable to a power tool, the drive guide comprising:

a shank including a tool coupling portion and a barrel coupling portion;

a barrel coupled to the barrel coupling portion of the shank, the barrel including a bit coupling portion configured to couple to a tool bit, the barrel also including a depth indicium disposed on a surface of the barrel; and a sleeve disposed concentrically about and slidable along the barrel;

wherein an edge of the sleeve provides a visual indicator to determine depth based on the depth indicium; and wherein the barrel includes a plurality of sets of depth indicia, and wherein each set of depth indicia includes a plurality of axially aligned and axially spaced markers.

20. A drive guide connectable to a power tool, the drive guide comprising:

a shank including a tool coupling portion and a barrel coupling portion;

a barrel coupled to the barrel coupling portion of the shank, the barrel including a bit coupling portion configured to couple to a tool bit, the barrel also including a depth indicium disposed on a surface of the barrel; and a sleeve disposed concentrically about and slidable along the barrel;

wherein an edge of the sleeve provides a visual indicator to determine depth based on the depth indicium; and wherein the depth indicium is laser etched into the barrel.

21. A drive guide connectable to a power tool, the drive guide comprising:

a shank including a tool coupling portion and a barrel coupling portion;

a barrel coupled to the barrel coupling portion of the shank, the barrel including a bit coupling portion configured to couple to a tool bit, the barrel also including a depth indicium disposed on a surface of the barrel; and a sleeve disposed concentrically about and slidable along the barrel;

wherein an edge of the sleeve provides a visual indicator to determine depth based on the depth indicium;

wherein the sleeve includes an indicator disposed adjacent the edge of the sleeve; and wherein the indicator on the sleeve has a distinct design from the depth indicium on the barrel.

* * * * *